US006015451A

United States Patent [19]

Anderson et al.

[11] Patent Number: 6,015,451

[45] Date of Patent: Jan. 18, 2000

[54] VAPOR RECOVERY SYSTEM

[75] Inventors: Thomas B. Anderson, Hants, United Kingdom; Elliott Drucker, Irvine, Calif.; John Dennis Robinson, Berks, United Kingdom

[73] Assignee: Fluor Corporation, Irvine, Calif.

[21] Appl. No.: 08/983,289

[22] PCT Filed: May 20, 1997

[86] PCT No.: PCT/GB97/01366

§ 371 Date: Apr. 13, 1998

§ 102(e) Date: Apr. 13, 1998

[87] PCT Pub. No.: WO96/41781

PCT Pub. Date: Dec. 27, 1996

[30] Foreign Application Priority Data

May 20, 1996 [GB] United Kingdom ..... 96303564

[51] Int. Cl.[7] ..... B01D 53/14

[52] U.S. Cl. ..... 95/184; 95/193; 95/194; 95/229; 95/237; 96/234; 96/242; 96/266

[58] Field of Search ..... 95/178, 179, 180, 95/184, 193, 194, 209, 229, 237, 238, 239, 240; 96/234, 266, 242

[56] References Cited

U.S. PATENT DOCUMENTS

| | | | |
|---|---|---|---|
| 2,423,156 | 7/1947 | Reid | 95/193 |
| 3,830,040 | 8/1974 | Hendrix | 95/193 |
| 3,855,337 | 12/1974 | Foral, Jr. et al. | 95/194 |
| 3,861,890 | 1/1975 | Doncer et al. | 95/194 |
| 3,947,258 | 3/1976 | Decker | 95/229 |
| 4,263,019 | 4/1981 | Minkkinen | 95/239 |
| 4,475,928 | 10/1984 | Jacobsen | 95/193 |
| 5,476,986 | 12/1995 | Jacobsen | 95/237 |

FOREIGN PATENT DOCUMENTS

| | | | |
|---|---|---|---|
| 501054 | 9/1992 | European Pat. Off. | 95/193 |
| 53-8368 | 1/1978 | Japan | 95/193 |
| WO 82/04260 | 12/1982 | WIPO | C10G 5/04 |
| WO 93/15166 | 8/1993 | WIPO | C10G 5/04 |

*Primary Examiner*—Duane S. Smith
*Attorney, Agent, or Firm*—Limbach & Limbach L.L.P.

[57] ABSTRACT

Apparatus for recovering volatile organic compounds (VOC) from VOC/inert gas mixtures leaving tanker holds during crude oil loading includes an absorption column 12 in which incoming VOC is absorbed into cold kerosene, a portion of the VOC rich kerosene leaving the absorption column being cooled in a cooler 88 and returned to the absorption column to contact incoming VOC/inert gas mixture and absorb further VOC. The remainder of the rich kerosene leaving the absorption column 12 passes to a buffer tank 34 where it is held. It is then pumped to an elevated pressure distillation (stripper) column 46, where VOC is separated from the kerosene by conventional rectification. VOC vapor leaving the top of the distillation column is condensed in condenser 72 and held in the VOC reflux tank 76. Liquid VOC from the reflux tank is passed to a crude oil pipeline 82; a portion of the liquid VOC from the reflux tank enters the top of the distillation column to act as reflux. Kerosene leaves the bottom of the distillation column 46 and passes to a storage tank 60 where it is held. From there, it passes through a cooler 66 to the absorption column, to absorb further VOC from incoming VOC/inert gas mixture. The coolers for this lean kerosene and for the rich kerosene which re-enters the absorption column are preferably cooled by the same refrigeration system 68. The buffer and storage tanks are size that the elevated pressure distillation column can run continuously.

38 Claims, 1 Drawing Sheet

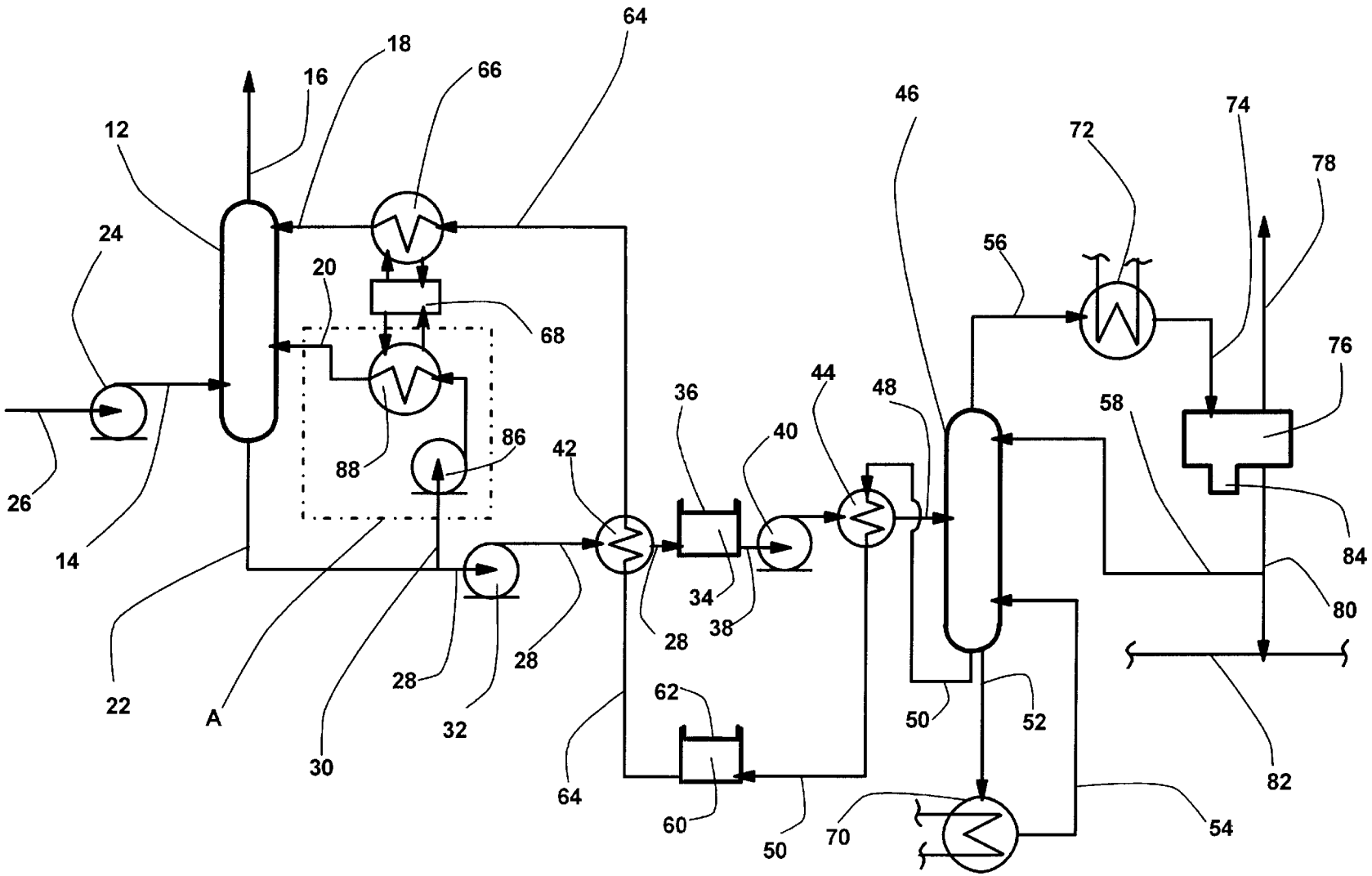
12
14
16
18
20
22
24
26
28
30
32
34
36
38
40
42
44
46
48
50
52
54
56
58
60
62
64
66
68
70
72
74
76
78
80
82
84
86
88
A

VAPOR RECOVERY SYSTEM

BACKGROUND OF THE INVENTION

This invention relates to vapour recovery systems suitable for recovery of entrained volatile organic compounds (VOC). It finds particular application in the recovery of vaporised VOC expelled from the holds of crude oil tanker ships during loading with crude oil. It also finds application in other situations where an intermittent supply of vaporised hydrocarbons is to be recovered.

The empty holds of crude oil tanker ships are held under inert gas; however, the empty holds inevitably contain some vaporised VOC and residual oil from the previous crude oil cargo. During loading of the holds with crude oil, these VOC, with the inert gas, are expelled from the holds, and further VOC are generated from the crude oil as it is loaded by vaporization from the surface.

Apart from at the start and end of loading operations, the flow of crude oil into the tanker hold is generally kept constant. Because of vaporization of VOC in the hold, the volumetric flow rate of vapour entering the apparatus substantially exceeds the flow of crude oil into the tanker hold. Towards the end of loading, the vapour can constitute up to 50% by volume of mixture entering the apparatus. Throughout the loading procedure, therefore, considerable amounts of VOC are expelled from the holds, entrains in inert gas.

The expelled VOC/inert gas mixture is commonly vented to atmosphere; however, it would be preferred to recover the VOC for use. A proposal for a system for achieving this has been made in WO-A-93/15166, which discloses a vapour recovery system in which a mixture of air and crude oil VOC is compressed and introduced into a washing column where it is washed with crude oil under pressure. The washed gases are then passed to an absorption column where they are contacted with petroleum at −25° C., which absorbs the VOC. The VOC-rich petroleum is passed via a small buffer tank to a distillation (stripper) column operating at around atmospheric pressure. The recovered VOC-lean petroleum is cooled and recycled to the absorption column, while the recovered VOC vapour is conveyed from the top of the distillation column to the inlet of the system, where it is mixed with the incoming air and crude oil VOC prior to compression.

The plant of this document recovers the crude oil VOC as vapour; if it is not desired to mix it with incoming air and crude oil vapour, it must be dispersed or liquefied. Further, the plant only operates intermittently, when there is incoming air and crude oil VOC. Thus, the plant must be idle when no tanker ship is being loaded; the requirement for frequent shut down and start up of the column means that it is practical only to use a column operating at or near atmospheric pressure.

The system described above is adapted from that disclosed in WO-A-82/04260. WO-A-82/04260 discloses a petrol vapour recovery system, in which air and petrol vapour pass to an absorption column, where the petrol vapour is entrained in cold petroleum distillate. The petrol-rich petroleum distillate passes to a buffer tank so that variations in the concentration of petrol in the petroleum distillate are largely evened out. The absorption column is run so that the concentration of petrol in the petrol-rich petroleum distillate is substantially constant, so that the buffer tank can be quite small. The petrol-rich petroleum distillate passes from the buffer tank to a distillation (stripper) column, where the petrol vapour is separated from the petroleum distillate. The petroleum distillate is held in a cooled storage tank from where it passes into the absorption column. The petrol vapour is entrained in liquid petrol in a second absorption column.

The distillation column of this system operates at about atmospheric pressure, and the system operates intermittently, when loading is taking place. The absorption of the separated petrol vapour in liquid petrol is economically feasible at the relatively small scale on which petrol vapour recovery systems operate; such a plant for recovery of crude oil VOC would be expensive to build.

A system capable of efficiently recovering crude oil VOC has been sought, and is provided by the present invention.

BRIEF SUMMARY OF THE INVENTION

According to a first aspect of the present invention there is provided a method for recovering hydrocarbons from a mixture of hydrocarbon vapour and another gas, the mixture being supplied intermittently, comprising:

absorbing the hydrocarbon vapour with cooled petroleum distillate in an absorber;

transferring the resulting vapour-rich petroleum distillate to a buffer tank;

transferring the vapour-rich petroleum distillate from the buffer tank to a distillation column;

stripping the vapour from the vapour-rich petroleum distillate in the distillation column;

transferring the vapour-lean petroleum distillate from the distillation column to a storage tank; and transferring the vapour-lean petroleum distillate from the storage tank to the absorber for absorption of hydrocarbon vapour, characterised in that the stripping is carried out continuously at elevated pressure, in that the vapour-rich petroleum distillate is pumped to the distillation column, and in that vapour-rich petroleum distillate is transferred continuously from the buffer tank to the distillation column and vapour-lean petroleum distillate is transferred continuously from the distillation column to the storage tank.

Preferably, the distillation column operates at between 7 and 10, preferably at about 9, bar absolute.

In a second aspect, the invention provides a method of absorbing hydrocarbon vapour from a mixture of hydrocarbon vapour and another gas into petroleum distillate comprising:

contacting the mixture with petroleum distillate to absorb the hydrocarbon vapour into the petroleum distillate;

characterised in that the method further comprises:

cooling a portion of the resulting vapour-rich petroleum distillate; and contacting the mixture with the cooled vapour-rich petroleum distillate.

Preferably the absorption step in the method of the first aspect of the invention is according to the second aspect.

In a third aspect, the invention provides apparatus for recovering hydrocarbons from a mixture of hydrocarbon vapour and another gas, the mixture being supplied to the apparatus intermittently, comprising:

an absorber in which incoming hydrocarbon vapour is absorbed into cooled petroleum distillate;

a distillation column for stripping absorbed vapour from the petroleum distillate;

a buffer tank between the absorber and the distillation column disposed to receive vapour-rich petroleum distillate from the absorber and supply it to the distillation column; and a storage tank between the distillation column and the absorber disposed to receive stripped vapour-lean petroleum distillate from the distillation column and supply it to the absorber, characterised in that the apparatus further comprises a pump between the absorber and the distillation column, preferably between the buffer tank and the distillation column, to supply vapour-rich petroleum distillate to the column under pressure, in that the distillation column is an elevated pressure distillation column, and in that the buffer and storage tanks are of a size such that vapour-rich petroleum distillate can be pumped continuously from the buffer tank to the distillation column and that vapour-lean petroleum distillate can be transferred continuously from the distillation column to the storage tank.

Preferably, the distillation column is adapted to operate at between 7 and 10, preferably at about 9, bar absolute.

In a fourth aspect, the invention provides an absorber for use in an apparatus for recovering hydrocarbons from a mixture of hydrocarbon vapour and another gas comprising an absorption column in which hydrocarbon vapour is absorbed in petroleum distillate characterised in that the absorber further comprises a cooler for cooling at least a portion of the vapour-rich petroleum distillate leaving the column and a pump disposed to return the cooled vapour-rich petroleum distillate to the absorption column.

Preferably, the vapour recovery apparatus of the third aspect of the invention includes an absorber according to the fourth aspect. In this case, it is preferred that apparatus includes a cooler between the vapour-lean petroleum distillate storage tank and the absorption column, for cooling vapour-lean petroleum distillate entering the absorption column and that this cooler and the cooler for the vapour-rich petroleum distillate recycled to the absorption column have a common source of refrigeration.

The first and third aspects of the invention allow continuous operation of the distillation column even when the absorber is not being used, and the use of a high pressure column enables substantially all the vapour recovered from the vapour-rich petroleum distillate in the distillation column to be condensed at moderate temperatures, for example at between 25° C. and 50° C. This allows condensation to be achieved simply, for example by heat exchange with cold water. Liquid hydrocarbons are easier to handle than hydrocarbon vapour. Since the column operates continuously, it does not have to handle as large an hourly throughput as an intermittently operating column; thus, a relatively small column and associated equipment can be used, reducing capital costs. The reduction in throughput can be as high as 50% in tanker loading applications, depending on the frequency of tanker loading.

It will be appreciated that the supply of the vapour/inert gas mixture to vapour recovery apparatus is intermittent, occurring only when loading of for example tanker ships is taking place. The buffer and storage tanks are appropriately sized so that they do not completely empty between batches of vapour mixture entering the apparatus. In the case of vapour mixture resulting from the loading of typical crude oil tanker ships with crude oil, a suitable volume for each of the tanks would be between about 3000 $m^3$ and about 8000 $m^3$. Floating roof tanks are preferred, and could typically have a diameter of about 20 m.

For other applications such as gasoline loading, differently sized tanks would be appropriate.

When the apparatus is receiving the vapour/inert gas mixture, for example from a tanker being loaded, the mass flow rate of vapour-rich kerosene entering the buffer tank is greater than the mass flow rate of vapour-rich petroleum distillate leaving it, so that vapour-rich petroleum distillate accumulates in the buffer tank. The size of the buffer tank is chosen so that all the vapour entering the apparatus during a loading cycle is either recovered from the accompanying inert gas or stored, as a vapour-rich petroleum distillate, in the buffer tank. Flow rates can be adjusted so that at the end of the loading cycle, there is sufficient vapour-rich petroleum distillate in the buffer tank to enable the distillation column to continue operating until the next loading cycle commences. When the apparatus is not receiving the mixture, vapour-lean petroleum distillate leaving the distillation column accumulates in the storage tank, which is sized to allow this. When the mixture is being received, the storage tank empties as the demand in absorber for vapour-lean petroleum distillate exceeds the supply for the distillation column.

The second and fourth aspects of the invention allow more efficient absorption of the vapour to be achieved, minimising the amount of petroleum distillate required in the system, and so the size of the apparatus required. In the case of apparatus absorbing crude oil VOC into kerosene, a reduction of 25% in the amount of kerosene required can be achieved.

In a fifth aspect, the invention provides a method of absorbing hydrocarbon vapour from a mixture of hydrocarbon vapour and another gas into petroleum distillate characterised in that the absorption is carried out at elevated pressure, preferably greater than 1.5 bar absolute, more preferably between 1.5 and 4 bar absolute and most preferably between 1.5 and 2.5 bar absolute. Also preferably the temperature of the said petroleum distillate is between −25° C. and −5° C.

By elevating the pressure at which the absorption takes place, the temperature of the petroleum distillate into which the hydrocarbon vapour is absorbed can be elevated without a loss in the efficiency of the absorption. This reduces the requirement for refrigeration, reducing building and running costs of plant.

In a sixth aspect, the invention provides apparatus including an absorption column adapted for use in a method according to a fifth aspect.

It is preferred that the absorption step in the first aspect of the invention is according to the fifth aspect. It is also preferred that the method of the second aspect is also according to the fifth aspect.

It is preferred that the absorber in the apparatus of the third aspect of the invention is according to the sixth aspect. It is also preferred that the absorber according to the fourth aspect of the invention is also according to the sixth aspect.

BRIEF DESCRIPTION OF THE DRAWING

The invention will be further described by way of example, with reference to the drawing which shows diagrammatically a vapour recover system according to the first and second aspects of the invention.

DETAILED DESCRIPTION OF THE INVENTION

The vapour recovery system shown in the drawing is particularly suitable for recovering VOC from VOC/inert gas mixtures expelled from crude oil tanker ship holds during loading of the holds with crude oil. The system comprises an absorption column 12, having a VOC/inert gas mixture inlet pipe 14 in its lower region, an inert gas outlet pipe 16 in its upper region, exhausting to atmosphere, a cold VOC-lean kerosene inlet pipe 18 in its upper region, a cold VOC-rich kerosene inlet pipe 20 in its lower middle region and a VOC-rich kerosene outlet pipe 22 in its lower region. The upstream end of the vapour/inert gas inlet pipe 14 is connected to the outlet of a blower 24, supplied by a VOC/inert gas transfer pipe 26. This pipe receives the VOC/inert gas mixture from the hold of a tanker ship being loaded with crude oil, through vapour collection arms and detonation protection systems and a tanker vapour knock-out vessel. The vapour rich kerosene outlet 22 of the absorption column 12 branches into a buffer tank supply pipe 28 and a cool pump around supply pipe 30. The buffer tank supply pipe 28 includes a first VOC-rich kerosene pump 32.

The apparatus includes a buffer tank 34 having a floating roof 36, an inlet provided by the buffer tank supply pipe 28 and an outlet pipe 38 connected to the inlet side of second VOC-rich kerosene pump 40.

A first kerosene heat exchanger 42 is disposed in the buffer tank supply pipe 28. A second kerosene heat exchanger 44 is disposed downstream of the second VOC-rich kerosene pump 40. The VOC-rich kerosene exchanges heat with VOC-lean kerosene in these two heat exchangers, as will be described below.

The apparatus includes a pressure distillation or stripper column 46 having a VOC-rich kerosene inlet pipe 48 feeding into its middle region, which is connected to the outlet side of the kerosene heat exchanger 44. The lower region of the distillation column 46 has a main VOC-lean kerosene outlet pipe 50, a secondary VOC-lean kerosene outlet pipe 52 and a hot VOC-lean kerosene inlet pipe 54. The upper region of the distillation column 46 has a VOC outlet pipe 56 and a condensed VOC reflux inlet pipe 58.

The main VOC-lean kerosene outlet pipe 50 communicates with a storage tank 60 having a floating roof 62. The main VOC-lean kerosene outlet pipe 50 has the second kerosene heat exchanger 44 disposed in it, where hot VOC-lean kerosene heat exchanges with cold VOC-rich kerosene. The storage tank 60 has a VOC-lean kerosene outlet pipe 64, in which is disposed the first kerosene heat exchanger 42, where relatively warm VOC-lean kerosene again exchanges heat with cold VOC-rich kerosene. The VOC-lean kerosene outlet pipe 64 of the storage tank 60 communicates with a VOC-lean kerosene cooler 66, the downstream side of which is connected to the VOC-lean kerosene inlet pipe 18 of the absorption column 12. The VOC-lean kerosene cooler 66 is cooled by a refrigeration system 68.

The secondary VOC-lean kerosene outlet pipe 52 from the bottom of the distillation column 46 communicates with a reboiler 70, the downstream side of which is connected to the hot VOC-lean kerosene inlet pipe 54 of the distillation column 46. Hot oil is supplied to the reboiler 70 to heat it; other heating media may be used.

The vapour outlet pipe 56 of the distillation column 46 is connected to a VOC condenser 72, which is cooled by cold water. The outlet pipe 74 from the condenser 72 opens into a reflux drum 76. The reflux drum 76 has a fuel gas outlet 78 and a condensed VOC product outlet pipe 80, opening into a crude oil pipeline 82. Alternatively, the product outlet pipe 80 carries the condensed VOC product to a storage vessel. A branch from the condensed VOC product outlet pipe 80 forms the liquid VOC reflux inlet pipe 58 of the column 46. The reflux drum 76 has a water trap 84.

Dashed line A encloses a cold pump-around system. This system is connected to the cold pump-around supply pipe 30 which branches off the VOC-rich kerosene outlet pipe 22 of the absorption column 12. The supply pipe 30 is connected through a pump 86 to a VOC-rich kerosene cooler 88, the outlet of which forms the cold VOC-rich kerosene inlet pipe 20 of the absorption column 12. The VOC-rich kerosene cooler 88 is cooled by the same refrigeration unit 68 as the VOC-lean kerosene cooler 66.

Additional pumps, water separators and other conventional equipment can be included in the apparatus.

In use, the VOC/inert gas mixture is drawn through the VOC/inert gas supply pipe 26 by the blower 24 and introduced into the absorption column 12 through the inlet pipe 14, at about 1.5 to 2.5 bar absolute. In the column 12, it is contacted with cold VOC-lean kerosene, which enters the column through the VOC-lean inlet pipe 18, and also with cold VOC-rich kerosene which enters the column through the VOC-rich inlet pipe 20 of the absorption column 12 from the cold pump around unit A. VOC from the VOC/inert gas mixture are absorbed into the cold kerosene; the VOC-rich kerosene leaves the absorption column 12 through the VOC-rich kerosene outlet pipe 22. The inert gas is vented to atmosphere through the inert gas vent pipe 16 at the top of the absorption column 12.

A portion of the VOC-rich kerosene leaving the absorption column 12 through the outlet pipe 22 is pumped through the cold pump around A where it is cooled in the cooler 88 and returned to the absorption column. The remainder of the VOC-rich kerosene leaving the absorption column 12 is pumped by the pump 32 in the buffer tank supply pipe 28 through the first kerosene heat exchanger 42 into the buffer tank 34, where it is held.

In the first kerosene heat exchanger 42 the relatively cold VOC-rich kerosene from the absorption column 12 cools relatively warm VOC-lean kerosene from the storage tank 60.

VOC-rich kerosene is pumped from the buffer tank 34 by pump 40 into the distillation column 46 at about 9.5 bar absolute, through the buffer tank outlet pipe 38, the second kerosene heat exchanger 44 and the vapour-rich kerosene inlet pipe 48 of the distillation column 46. In the second kerosene heat exchange 44, the relatively cold VOC-rich kerosene from buffer tank 34 cools the relatively warm VOC-lean kerosene from the distillation column 46.

In the pressure distillation column 46 the VOC-rich kerosene undergoes conventional rectification to separate the VOC from the kerosene. VOC-lean kerosene accumulates in the bottom of the column while the VOC accumulate at the top. The VOC-lean kerosene leaves the bottom of the distillation column 46 through the VOC-lean kerosene outlet pipe 50, and passes to the VOC-lean kerosene storage tank 60, where it is held, having been cooled in the second kerosene heat exchanger 44 by the relatively cold VOC-rich kerosene leaving the buffer tank 34. From the storage tank 60, the VOC-lean kerosene passes, by the VOC-lean kerosene storage tank outlet pipe 64 and the first kerosene heat exchanger 42, where it is further cooled by heat exchange with the relatively cold VOC-rich kerosene leaving the absorption column 12, to the VOC-lean kerosene cooler 66 where it is cooled to about −25° C. From here the cooled VOC-lean kerosene passes into the absorption column 12 through the VOC lean kerosene inlet pipe 18.

VOC leaving the upper portion of the distillation column 46 through the VOC outlet pipe 56 are condensed in the VOC condenser 72, from where they pass through the condenser outlet pipe 74 into the reflux drum 76. Any water in the condensed VOC collects in the water collector 84 on the underside of the reflux drum. From the reflux drum, the uncondensed VOC is taken off to be used as fuel gas for heating the hot oil used in the reboiler 70 which heats the minor portion of the VOC-lean kerosene taken off from the distillation column 46 through the secondary outlet pipe 52 and returned to the distillation column through the hot vapour-lean kerosene inlet pipe 54. The condensed VOC leaves the reflux drum through the VOC product outlet pipe 80, and is mixed with crude oil in a crude oil pipeline 82. A portion of the VOC product is introduced into the top of the distillation column 46 to act as reflux through the condensed VOC inlet pipe 58, which branches off the VOC product pipe 80.

As already noted, a subsidiary portion of the lean kerosene accumulating in the bottom of the distillation column 46 is drawn off through the secondary lean kerosene outlet pipe 52, heated in a reboiler 70 and reintroduced into the lower part of the distillation column through hot VOC-lean kerosene pipe 54. This serves to provide the heat energy necessary for the distillation column to rectify the incoming VOC-rich kerosene.

For typical crude oil tanker ship loading operations, loading rates may vary from 5000 to 20000 $m^3$/hr of crude oil, giving rise to vapour flows of from 6000 to 30000 normal $m^3$/hr, depending on ship characteristics, loading conditions and crude oil light ends composition. Typically, about 20000 normal $m^3$/hr VOC/inert gas mixture will enter the VOC recovery plant and be compressed to about 1.6 bar absolute by the blower 24. The compressed mixture enters the absorption column 12 where it is contacted with about 240 tonnes/hr cold lean kerosene at −20° C. and about 480 tonnes/hr of cold rich kerosene at −20° C. from the pump-around A. This achieves about 90–94% removal of VOC from the mixture, depending on the VOC composition. The VOC-rich kerosene pump 32 pumps rich kerosene from the absorption column 12 to the first heat exchanger 42 where it is heated by lean kerosene to between 0 and 5° C. before entering the buffer tank 34.

From the buffer tank 34, rich kerosene is pumped continuously at a rate of about 125 tonnes/hr to the stripper column 46 through the second heat exchanger 44, entering the column at about 9.5 bar absolute and 250° C. Lean kerosene leaves the bottom of the column at about 300° C. and is heat exchanged with the incoming rich kerosene in the second heat exchanger and may then be further cooled to enter the lean kerosene storage tank at about 35° C. for use in the absorption column 12 during the next tanker loading operation.

VOC vapour stripped from the rich kerosene in the stripper column leaves the top of the column and is condensed in the condenser 72 and collected in the reflux drum 76 at about 45–50° C. Some of the condensed liquid is returned to the column as reflux, and the main VOC product is available as a liquid at about 8.5 bar absolute for disposal or further processing. The residual uncondensed VOC vapour from the reflux drum can be used as fuel gas directly or indirectly to heat the column reboiler 70.

The invention provides vapour recovery apparatus which allows the distillation column to function continuously, at a substantially constant feed rate, even though the supply of vapour/gas mixture to the apparatus is intermittent, and the concentration of vapour in the incoming mixture is not constant. This removes problems associated with start up and shut down of the column, reduces maintenance, capital and operating costs, and generates a continuous supply of recovered vapour. The improvement in absorption efficiency achieved by the cold pump around reduces the petroleum distillate requirement of the apparatus, allowing it to be smaller and thus cheaper.

We claim:

1. A method for recovering hydrocarbons from a mixture of hydrocarbon vapor and another gas, the mixture being supplied intermittently, comprising:

absorbing the hydrocarbon vapor with cooled petroleum distillate in an absorber (12);

transferring the resulting vapor-rich petroleum distillate to a buffer tank (34);

continuously pumping the vapor-rich petroleum distillate from the buffer tank to a distillation column (46);

continuously stripping at elevated pressure the vapor from the vapor-rich petroleum distillate in the distillation column (46);

continuously transferring the vapor-lean petroleum distillate from the distillation column (46) to a storage tank (60); and transferring the vapor-lean petroleum distillate from the storage tank (60) to the absorber (12) for absorption of hydrocarbon vapor.

2. A method according to claim 1 in which the stripping is carried out at a pressure sufficient to allow the hydrocarbon vapor stripped from the valor-rich petroleum distillate to be condensed by cooling water.

3. A method according to claim 2 in which the stripping is carried out at between 7 and 10 bar absolute.

4. A method according to claim 1 in which vapor-lean petroleum distillate is cooled as it is transferred to the absorber (12).

5. A method according to claim 4 in which vapor-rich petroleum distillate being transferred between the absorber (12) and the buffer tank (34) is heat exchanged with valor-lean petroleum distillate being transferred between the storage tank (60) and the absorber (12) to provide at least part of the cooling of the vapor-lean petroleum distillate.

6. A method according to claim 1 in which vapor-rich petroleum distillate being transferred between the absorber (12) and the buffer tank (34) is heat exchanged with vapor-lean petroleum distillate being transferred between the storage tank (60) and the absorber (12).

7. A method according to claim 1 in which vapor-rich petroleum distillate being transferred between the buffer tank (34) and the distillation column (46) is heat exchanged with vapor-lean petroleum distillate being transferred between the distillation column (46) and the storage tank (60).

8. A method according to claim 1 in which vapor-rich petroleum distillate is pumped between the absorber (12) and the buffer tank (34).

9. A method according to claim 1 in which vapor-rich petroleum distillate is pumped between the buffer tank (34) and the distillation column (46).

10. A method of absorbing hydrocarbon vapor from a mixture of hydrocarbon vapor and another gas into petroleum distillate comprising:

contacting the mixture with petroleum distillate to absorb the hydrocarbon vapor into the petroleum distillate;

cooling a portion of the resulting vapor-rich petroleum distillate; and contacting the mixture with the cooled vaor-rich petroleum distillate.

11. A method according to claim 10 comprising:

(a) contacting the mixture with cooled vapor-lean petroleum distillate and cooled vapor-rich petroleum distillate;

(b) cooling a portion of the resulting vapor-rich petroleum distillate; and (c) using the cooled vapor-rich petroleum distillate from step (b) in step (a).

12. Apparatus for recovering hydrocarbons from a mixture of hydrocarbon vapor and another gas, the mixture being supplied to the apparatus intermittently, comprising:

an absorber (12) in which incoming hydrocarbon vapor is absorbed into cooled petroleum distillate;

an elevated pressure distillation column (46) for stripping absorbed vapor from the petroleum distillate;

a buffer tank (34) between the absorber (12) and the distillation column (46) disposed to receive vapor-rich petroleum distillate from the absorber and supply it to the distillation column;

a pump (40) between the buffer tank (34) and the distillation column (46) to supply vapor-rich petroleum distillate to the column under pressure; and a storage tank (60) between the distillation column (46) and the absorber (12) disposed to receive stripped vapor-lean petroleum distillate from the distillation column and supply it to the absorber, wherein the buffer (34) and storage (60) tanks are of a size such that vapor-rich petroleum distillate can be pumped continuously from the buffer tank to the distillation column and that vapor-lean petroleum distillate can be transferred continuously from the distillation column to the storage tank.

13. Apparatus according to claim 12 in which the distillation column (46) is adapted to operate at a sufficient pressure above ambient that substantially all the hydrocarbon vapor stripped from the vapor-rich petroleum distillate can be condensed by cooling water.

14. Apparatus according to claim 13 in which substantially all the hydrocarbon vapor stripped from the vapor-rich petroleum distillate can be condensed at a temperature between 25° C. and 50° C.

15. Apparatus according to claim 13 in which the distillation column (46) is adapted to operate at between 7 and 10 bar absolute.

16. Apparatus according to claim 12 in which a first heat exchanger (42) for heat exchange between vapor-rich petroleum distillate and vapor-lean petroleum distillate is disposed in the vapor-rich petroleum distillate line (28) from the absorber (12) to the buffer tank (34) and in the vapor-lean petroleum distillate line (64) from the storage tank (60) to the absorber.

17. Apparatus according to claim 12, 13, or 16 which a second heat exchanger (44) for heat exchange between vapor-rich petroleum distillate and valor-lean petroleum distillate is disposed in the vapor-rich petroleum distillate line (48) from the buffer tank (34) to the distillation column (46) and in the vapor-lean petroleum distillate line (50) from the distillation column to the storage tank (60).

18. Apparatus according to claim 12, 13, or 16 in which a second pump (32) is disposed in the vapor-rich petroleum distillate line (28) between the absorber (12) and the buffer tank (34).

19. Apparatus according to claim 12, 13, or 16 further comprising a vapor condenser (72) disposed to receive hydrocarbon vapor from the upper part of the distillation column (46).

20. Apparatus according to claim 19 in which the vapor condenser (72) is in fluid communication with a hydrocarbon pipeline (82) or with a storage vessel.

21. Apparatus according to claim 12, 13, or 16 further comprising a vapor-lean petroleum distillate reboiler (70) disposed to receive vapor-lean petroleum distillate from the lower region of the distillation column (46) and to return the heated vapor-lean petroleum distillate to the lower region of the distillation column.

22. Apparatus according to claim 12, 13, or 16 in which uncondensed hydrocarbon vapor from the upper part of the distillation column (46) is used as fuel to heat the column.

23. Apparatus according to claim 12, 13, or 16 in which a vapor-lean petroleum distillate cooler (66) is disposed in the vapor-lean petroleum distillate line from the storage tank (60) or the first heat exchanger (42) if present to the absorber (12).

24. An absorber for use in an apparatus for recovering hydrocarbons from a mixture of hydrocarbon vapor and another gas comprising an absorption column (12) in which hydrocarbon vapor is absorbed in petroleum distillate a cooler (88) for cooling at least a portion of the vapor-rich petroleum distillate leaving the column and a pump (86) disposed to return the cooled vapor-rich petroleum distillate to the absorption column.

25. An absorber according to claim 24 in which the absorption column (12) has an inlet (14) for vapor, an inlet (18) for vapor-lean petroleum distillate, an outlet (22) for vapor-rich petroleum distillate and an inlet (20) for cooled vapor-rich petroleum distillate in which the cooler (88) and the pump (86) are disposed between the vapor-rich petroleum distillate outlet and the vapor-rich petroleum distillate inlet.

26. Apparatus according to claim 24 or 25 for in which the cooled vapor-rich petroleum distillate is returned to the lower region of the absorption column (12).

27. Apparatus according to claim 12, 13, or 16 in which the absorber comprises an absorption column (12) in which hydrocarbon vapor is absorbed in petroleum distillate, a cooler (88) for cooling at least a portion of the vapor-rich petroleum distillate leaving the column and a pump (86) disposed to return the cooled vapor-rich petroleum distillate to the absorption column.

28. Apparatus according claim 27 in which a vapor-lean petroleum distillate cooler (66) is disposed in the vapor-lean petroleum distillate line from the storage tank (60) or the first heat exchanger (42) if present to the absorber (12) and in which the vapor-lean petroleum distillate cooler (88) and the cooler (66) for cooling at least a portion of the vapor-rich petroleum distillate leaving the column are cooled by the same source of refrigeration (68).

29. A method of absorbing hydrocarbon vapor from a mixture of hydrocarbon vapor and another gas into petroleum distillate in which the absorption is carried out at elevated pressure.

30. A method according to claim 29 in which the elevated pressure is up to 4 bar absolute.

31. A method according to claim 29 or 30 in which the elevated pressure is at least 1.5 bar absolute.

32. A method according to claim 29 or 30 in which the elevated pressure is up to 2.5 bar absolute.

33. A method according to claim 29 or 30 in which the temperature of the said petroleum distillate is between −25° C. and −5° C.

34. A method for recovering hydrocarbons from a mixture of hydrocarbon vapor and another gas, the mixture being supplied intermittently, comprising:

absorbing the hydrocarbon vapor with cooled petroleum distillate in an absorber (12) by contacting the mixture with petroleum distillate to absorb the hydrocarbon vapor into the petroleum distillate; cooling a portion of the resulting vapor-rich petroleum distillate; and contacting the mixture with the cooled vapor-rich petroleum distillate;

transferring the resulting vapor-rich petroleum distillate to a buffer tank (34);

continuously pumping the vapor-rich petroleum distillate from the buffer tank to a distillation column (46);

continuously stripping at elevated pressure the vapor from the vapor-rich petroleum distillate in the distillation column (46);

continuously transferring the vapor-lean petroleum distillate from the distillation column (46) to a storage tank (60); and transferring the vapor-lean petroleum distillate from the storage tank (60) to the absorber (12) for absorption of hydrocarbon vapor.

35. A method according to claim 34 in which the absorption is carried out at elevated pressure.

36. A method according to claim 1 or 2 in which the absorption is carried out at elevated pressure.

37. A method according to claim 10 or 11 in which the absorption is carried out at elevated pressure.

38. A method according to claim 34 in which the vapor-lean petroleum distillate is cooled as it is transferred to the absorber (12), at least part of the said cooling being provided by the same cooler (68) as cools the cooled portion of the vapor-rich petroleum distillate.

* * * * *